US010041493B2

(12) United States Patent
Choi et al.

(10) Patent No.: US 10,041,493 B2
(45) Date of Patent: Aug. 7, 2018

(54) SCROLL COMPRESSOR

(71) Applicant: LG ELECTRONICS INC., Seoul (KR)

(72) Inventors: Yongkyu Choi, Seoul (KR); Kangwook Lee, Seoul (KR); Cheolhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 272 days.

(21) Appl. No.: 14/710,704

(22) Filed: May 13, 2015

(65) Prior Publication Data

US 2016/0047378 A1 Feb. 18, 2016

(30) Foreign Application Priority Data

Aug. 13, 2014 (KR) ..... 10-2014-0105227

(51) Int. Cl.
*F04C 18/02* (2006.01)
*F04C 28/26* (2006.01)
(Continued)

(52) U.S. Cl.
CPC ..... *F04C 18/0215* (2013.01); *F04C 18/0261* (2013.01); *F04C 29/12* (2013.01); *F04C 23/008* (2013.01)

(58) Field of Classification Search
CPC ..... F04C 18/0215; F04C 18/0261; F04C 23/008; F04C 29/12
See application file for complete search history.

(56) References Cited

U.S. PATENT DOCUMENTS 4,714,415 A * 12/1987 Mizuno ..... F04C 18/0215 418/14
4,818,195 A * 4/1989 Murayama ..... F04C 18/0215 418/15
(Continued)

FOREIGN PATENT DOCUMENTS

CN 1367320 9/2002
CN 101675248 3/2010
(Continued)

OTHER PUBLICATIONS

Chinese Office Action dated Feb. 4, 2017 (English Translation).
(Continued)

*Primary Examiner* — Mark Laurenzi
*Assistant Examiner* — Anthony Ayala Delgado
(74) *Attorney, Agent, or Firm* — Ked & Associates LLP

(57) ABSTRACT

A scroll compressor is provided that may include a first scroll provided with a discharge port, a second scroll engaged with the first scroll to form a first compression chamber and a second compression chamber, and a rotational shaft provided with an eccentric portion eccentrically coupled to the first scroll or the second scroll The eccentric portion may overlap the first and second compression chambers in a radial direction. The discharge port may be provided with at least one discharge inlet and a discharge outlet The at least one discharge inlet may include a plurality of discharge inlets, which have different areas from each other, whereby a refrigerant of each compression chamber may be smoothly discharged, thereby preventing an over-compression loss due to a delay of discharge.

18 Claims, 9 Drawing Sheets

(51) Int. Cl.
*F04C 29/12* (2006.01)
*F04C 23/00* (2006.01)

(56) References Cited

U.S. PATENT DOCUMENTS

| | | | | |
|---|---|---|---|---|
| 8,790,098 | B2 * | 7/2014 | Stover | F04C 18/0215 417/307 |
| 9,267,501 | B2 | 2/2016 | Akei | |
| 2010/0303659 | A1 * | 12/2010 | Stover | F04C 18/0215 418/24 |

FOREIGN PATENT DOCUMENTS

| | | |
|---|---|---|
| CN | 102042224 | 5/2011 |
| CN | 102678550 | 9/2012 |
| JP | 5-280476 | 10/1993 |
| KR | 10-1059880 | 8/2011 |

OTHER PUBLICATIONS

U.S. Appl. No. 15/817,531, filed Nov. 20, 2017.
U.S. Appl. No. 15/817,584, filed Nov. 20, 2017.
U.S. Appl. No. 15/817,657, filed Nov. 20, 2017.
U.S. Office Action issued in U.S. Appl. No. 15/817,657 dated Apr. 6, 2018.

* cited by examiner

SCROLL COMPRESSOR

CROSS-REFERENCE TO RELATED APPLICATION(S)

Pursuant to 35 U.S.C. § 119(a), this application claims priority to Korean Application No. 10-2014-0105227, filed in Korea on Aug. 13, 2014, the contents of which is incorporated by reference herein in its entirety.

BACKGROUND

1. Field

A scroll compressor is disclosed herein.

2. Background

In general, a scroll compressor is widely used for refrigerant compression in an air-conditioning apparatus, for example, as it is capable of obtaining a relatively higher compression ratio than other types of compressors, and acquiring a stable torque resulting from smooth strokes of suction, compression, and discharge of the refrigerant. A behavior of the scroll compressor is dependent on shapes of a fixed wrap and an orbiting wrap. The fixed wrap and the orbiting wrap may have a random shape, but typically they have a shape of an involute curve, which is easy to manufacture.

The term "involute curve" refers to a curve corresponding to a track drawn by an end of a thread when unwinding the thread wound around a basic circle with a predetermined radius. When such an involute curve is used, the wrap has a uniform thickness, and a rate of volume change of a plurality of compression chambers is constantly maintained. Hence, a number of turns of the wrap should increase to obtain a sufficient compression ratio, which may, however, cause the compressor to be increased in size corresponding to the increased number of turns of the wrap.

The orbiting scroll typically includes a disk, and the orbiting wrap is located on one side of the disk. A boss having a predetermined height is formed at a surface of the disk opposite to the side at which the orbiting wrap is formed. The boss is eccentrically connected to a rotational shaft, which is coupled to a rotor of the motor, so as to allow the orbiting scroll to perform an orbiting motion. Such an arrangement allows the orbiting wrap to be formed on almost an entire surface of the disk, thereby reducing a diameter of the disk for obtaining a uniform compression ratio. However, as the orbiting wrap and the boss are spaced from each other in an axial direction, a point of application of a repulsive force of a refrigerant applied upon compression and a point of application of a reaction force, which is opposed to the repulsive force of the refrigerant, are spaced apart from each other in the axial direction. Accordingly, the repulsive force and the reaction force are applied to each other as a torque during operation of the compressor. This causes the orbiting scroll to be inclined, thereby generating more vibration and noise.

To solve this problem, for example, Korean Patent Registration No. 10-1059880, which is incorporated herein by reference, introduced a scroll compressor in which a coupled portion between a rotational shaft and an orbiting scroll is located on a same plane as an orbiting wrap. This type of scroll compressor can solve the problem that the orbiting scroll is inclined because a point of application of a repulsive force of a refrigerant and a point of application of a reaction force against the repulsive force are opposed to each other at a same height.

In the scroll compressor, as only one discharge port to discharge a refrigerant compressed in each compression chamber is provided, a refrigerant compressed in a first compression chamber formed on an outer surface of the orbiting wrap and a refrigerant compressed in a second compression chamber formed on an inner surface of the orbiting wrap are discharged through the one discharge port.

However, when the one discharge port is provided, it may be easy to design a same discharge time point for both compression chambers only when the discharge port is located at a center of a compression unit or device. However, in a scroll compressor having a structure that the rotational shaft overlaps the orbiting wrap in a radial direction, the rotational shaft is located at a central portion of the orbiting scroll, and thereby the discharge port is located eccentric from the center of the compression device. Accordingly, as illustrated in FIG. 1, a time point of opening a discharge port DP for a first compression chamber S11 and a time point of opening the discharge port DP for the second compression chamber S12 are different from each other, whereby an over-compression loss due to a delayed discharge is brought about in a compression chamber from which a refrigerant is discharged relatively late.

Also, in the scroll compressor having the structure that the rotational shaft overlaps the orbiting wrap in the radial direction, even though the second compression chamber S12 has a higher compression ratio than the first compression chamber S11, the second compression chamber S12 is opened later than the first compression chamber S11 or has a same discharge area as the first compression chamber S11. This results in a further increase in over-compression loss in the second compression chamber S12. In FIG. 1, unexplained reference numeral 32 is a fixed scroll, while unexplained reference numeral 33 is an orbiting scroll.

BRIEF DESCRIPTION OF THE DRAWINGS

Embodiments will be described in detail with reference to the following drawings in which like reference numerals refer to like elements, and wherein.

DETAILED DESCRIPTION

Figure 1:
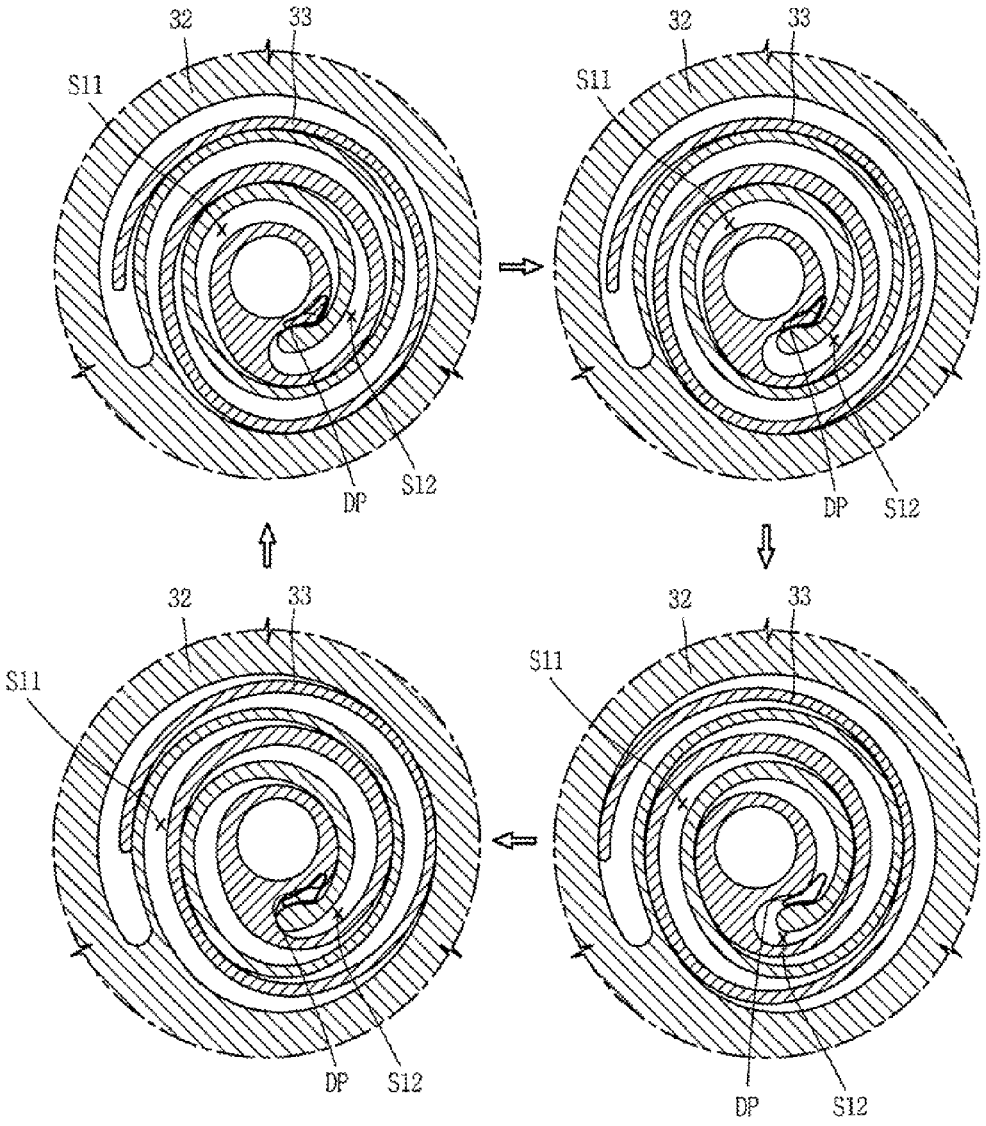
FIG. 1 RELATED ART
FIG. 1 is a planar view illustrating a state in which refrigerants of both compression chambers are discharged in the related art scroll compressor.

Hereinafter, description will be given in detail of a scroll compressor disclosed herein with reference to the accompanying drawings. Wherein possible, like reference numerals have been used to indicate like elements, and repetitive disclose has been omitted.

Figure 2:
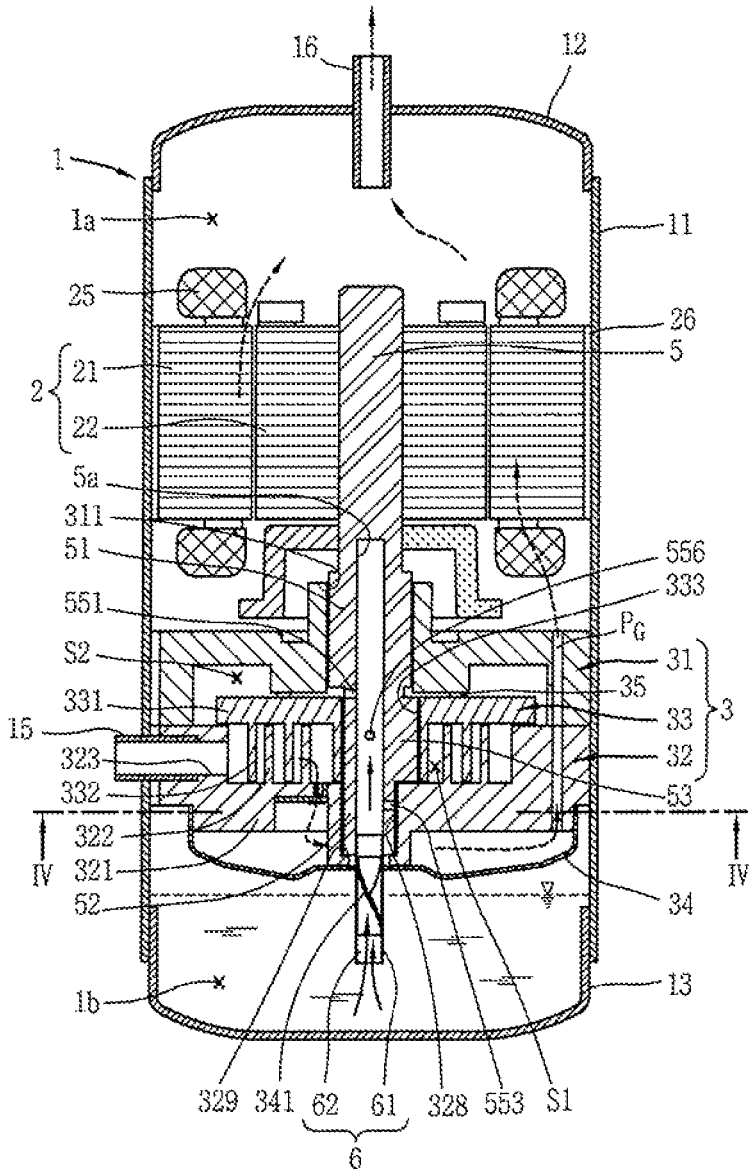
FIG. 2 is a longitudinal sectional view of a scroll compressor in accordance with an embodiment.
Figure 3:
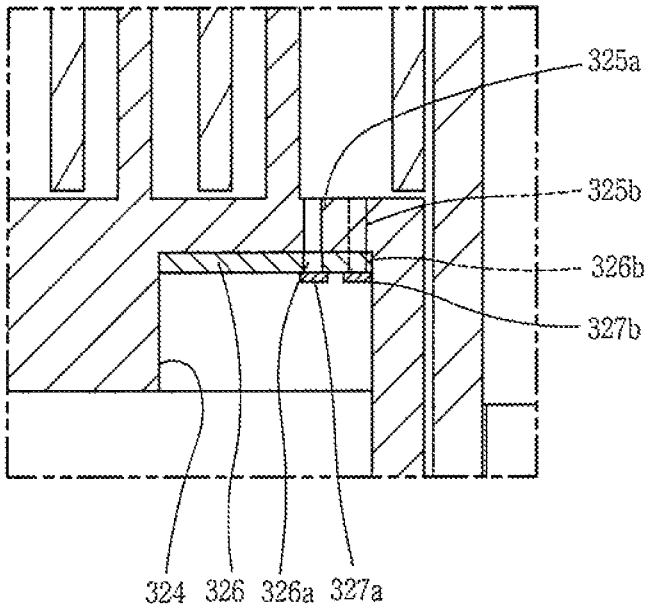
FIG. 3 is an enlarged longitudinal sectional view of a surrounding area of a discharge port of the scroll compressor of FIG. 2.
Figure 4:
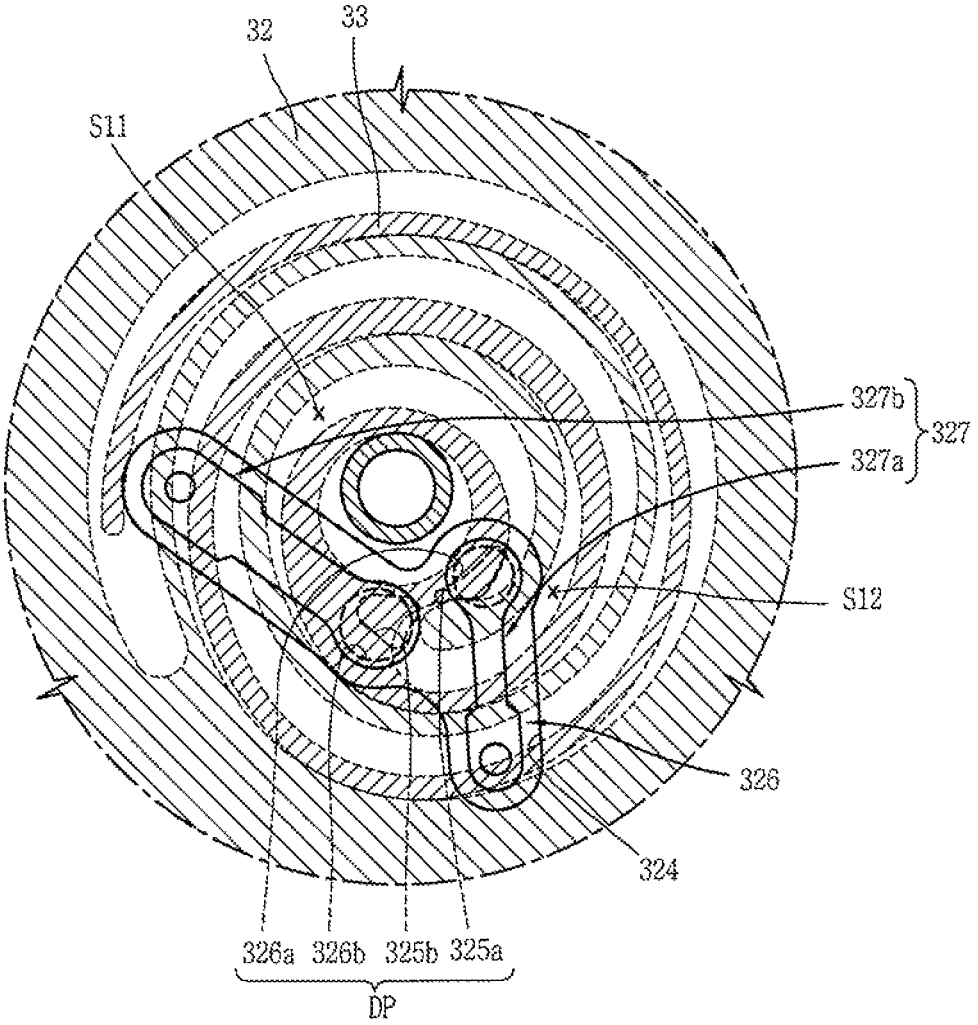
FIG. 4 is a sectional view taken along the line IV-IV of FIG. 2.
Figure 5:
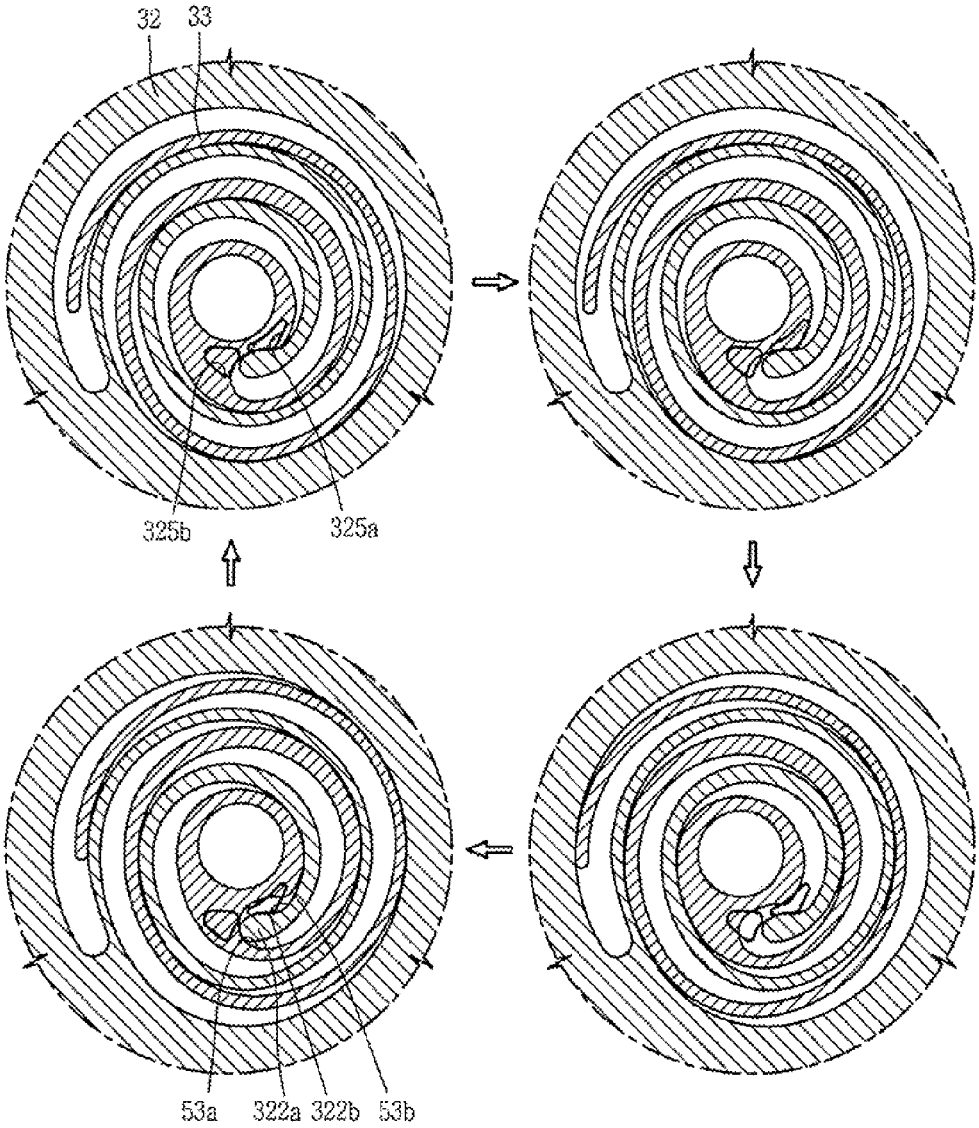
FIG. 5 is a planar view illustrating a process in which a discharge port that communicates with each of compression chambers is opened in the scroll compressor of FIG. 2.

FIG. 2 is a longitudinal sectional view of a scroll compressor in accordance with an embodiment. FIG. 3 is an enlarged longitudinal sectional view of a surrounding area of a discharge port DP of the scroll compressor of FIG. 2. FIG. 4 is a sectional view taken along the line IV-IV of FIG. 2. FIG. 5 is a planar view illustrating a process in which a discharge port DP that communicates with each of compression chambers S11 and S12 is opened in the scroll compressor of FIG. 2.

As illustrated in FIGS. 2 to 5, a bottom compression type scroll compressor according to this embodiment may include a casing 1, a motor 2 provided within an inner space 1*a* of the casing 1 to generate a rotational force, and a compression unit or device 3 provided below the motor 2 to compress a refrigerant by receiving the rotational force transferred from the motor 2. The casing 1 may include a cylindrical shell 11 forming a hermetic container, an upper shell 12 that covers a top of the cylindrical shell 11 to form the hermetic container, and a lower shell 13 that covers a bottom of the cylindrical shell 11 to form the hermetic container and simultaneously form an oil storage space 1*b*.

A refrigerant suction pipe 15 may penetrate through a side surface of the cylindrical shell 11 to communicate directly with a suction chamber of the compression device 3, and a refrigerant discharge pipe 16 that communicates with the inner space 1*a* of the casing 1 may be provided at a top of the upper shell 12. The refrigerant suction pipe 16 may correspond to a path along which a compressed refrigerant, which may be discharged from the compression device 3 into the inner space 1*a* of the casing 1, may be discharged outside of the casing 1. An oil separator (not illustrated), in which oil mixed with the discharged refrigerant may be separated from the refrigerant, may be connected to the refrigerant discharge pipe 16.

A stator 21 forming the motor 2 may be fixed to an upper portion of the casing 1. A rotor 22 that forms the motor 2 together with the stator 21 and is rotated by interaction with the stator 21 may be rotatably provided within the stator 21.

The stator 21 may be provided with a plurality of slots (no reference numeral) formed on an inner circumferential surface thereof along a circumferential direction. A coil 25 may be wound around each of the plurality of slots. A passage 26 may be formed by cutting an outer circumferential surface of the stator 21 into a D-cut shape, for example, such that refrigerant or oil may flow between the outer circumferential surface of the stator 21 and an inner circumferential surface of the cylindrical shell 11.

A main frame 31 that forms the compression device 3 may be provided below the stator 21 with a predetermined gap therebetween, and may be fixed to a lower side of the casing 1. A fixed scroll 32 (hereinafter, also referred to as a "first scroll") may be fixed to a lower surface of the main frame 31 interposing therebetween an orbiting scroll 33 (hereinafter, also referred to as a "second scroll"), which may be eccentrically coupled to a rotational shaft 5, which will be discussed hereinbelow. The orbiting scroll 33 may be installed between the main frame 31 and the fixed scroll 32 to perform an orbiting motion. The orbiting scroll 33 may form a plurality of compression chambers S1, which may include a suction chamber, an intermediate pressure chamber, and a discharge chamber, along with the fixed scroll 32 while performing the orbiting motion. Of course, the fixed scroll 32 may be coupled to the main frame 31 to be movable up and down.

The main frame 31 may have an outer circumferential surface which may be, for example, shrink-fitted or welded onto the inner circumferential surface of the cylindrical shell 11. A main bearing 311, in which a first bearing 51 of the rotational shaft 5, which will be discussed hereinbelow, may be rotatably inserted and supported, may be formed through a center of the main frame 31 in an axial direction. A back pressure chamber 52, which may form a space along with the fixed scroll 32 and the orbiting scroll 33 so as to support the orbiting scroll 33 by pressure of the space, may be formed at a lower surface of the main frame 31.

The fixed scroll 32 may include a disk 321 formed in an approximately circular shape, and a fixed wrap 322 formed on an upper surface of the disk 321 and engaged with an orbiting wrap 332, which will be discussed hereinbelow, so as to form the compression chambers S1. The fixed wrap 322 may have a shape including a plurality of arcs with different diameters and origin points connected such that a wrap curve may have irregularity. A protrusion 322*a* may be provided on an inner end portion of the fixed wrap 322, and a decreasing portion 322*b* may be formed on or at one side surface of the protrusion 322*a* to be engaged with an increasing portion 53*b* of the orbiting wrap 322, which will be discussed hereinbelow, thereby improving a compression ratio of a first compression chamber S11.

A suction port 323, which may be connected with the refrigerant suction pipe 15, may be formed at one side of the fixed wrap 322, and a discharge port DP that communicates with the discharge chamber and allows a compressed refrigerant to be discharged therethrough may be formed at the disk 321.

The discharge port DP may have an inlet 325*a*, 325*b* and an outlet 326*a*, 326*b*, which have different shapes from each other. The inlet 325*a*, 325*b* of the discharge port DP may be formed on the fixed scroll 32, and a valve plate 326, which may include the outlet 326*a*, 326*b* of the discharge port DP that communicates with the inlet 325*a*, 325*b* of the discharge port DP, may be coupled to a lower surface of the fixed scroll 32.

A plate mounting recess 324 may be recessed into the lower surface of the fixed scroll 32 by a predetermined depth. In view of reducing a dead volume of the discharge port DP, the valve plate 326 may be inserted into the plate mounting recess 324.

A plurality of the inlet 325*a*, 325*b* of the discharge port DP may be provided. For example, the plurality of inlets 325*a* and 325*b* of the discharge port DP may include a first discharge inlet 325*a* that communicates with the first compression chamber S11, and a second discharge inlet 325*b* that communicates with a second compression chamber S12. The first compression chamber S11 may be a compression chamber formed on or at an outer surface of an orbiting wrap 332, and the second compression chamber S12 may be a compression chamber formed on or at an inner surface of the orbiting wrap 332. In comparison with the second compression chamber S12, the first compression chamber S11 may exhibit an early introduction of a refrigerant therein, and may have a relatively long compression path. However, the first compression chamber S11 may have a relatively lower compression ratio than the second compression chamber S12 as the orbiting wrap 332 has irregularity. Also, in comparison with the first compression chamber S11, the second compression chamber S12 may exhibit a late introduction of a refrigerant therein and may have a relatively short compression path. However, the second compression chamber S12 may have a relatively higher compression ratio than the first compression chamber S11 as the orbiting wrap 332 has the irregularity.

Therefore, the refrigerant discharged from the first compression chamber S11 may flow faster than the refrigerant discharged from the second compression chamber S12. Taking into account this, the second discharge inlet 325*b* may be formed to have a larger area than the first discharge inlet 325*a*. That is, if the first discharge inlet 325*a* and the second discharge inlet 325*b* have a same area or the first discharge inlet 325*a* has a wider area than the second discharge inlet 325*b*, the refrigerant may be discharged through the second discharge inlet 325*b* by a relatively high discharge pressure and at a relatively fast flow speed, but may fail to be smoothly discharged due to an increased flow resistance caused by a narrow area, namely, a narrow discharge area of the second discharge inlet 325*b*. Therefore, as illustrated in this embodiment, by forming the second discharge inlet 325*b* to be larger than the first discharge inlet 325*a* in area, the refrigerant of the second compression chamber S21 may be quickly discharged at a relatively high discharge pressure and at a relatively fast flow speed.

A plurality of the outlet 326*a*, 326*b* of the discharge port DP may be provided, similar to the plurality of inlets 325*a*, 325*b* of the discharge port DP. For example, the plurality of outlets 326*a* and 326*b* of the discharge port DP may include a first discharge outlet 326*a* that communicates with the first discharge inlet 325*a*, and a second discharge outlet 326*b* that communicates with the second discharge inlet 325*b*. The first discharge outlet 326*a* and the second discharge outlet 326*b* may have a same area as each other. However, the second discharge outlet 326*b* may have a wider area than the first discharge outlet 326*a*.

When the second discharge outlet 326*b* has a large area, as illustrated in relation to the plurality of inlets 325*a*, 325*b* of the discharge port DP, even though the refrigerant discharged from the second compression chamber S12 flows faster due to the higher compression ratio of the second compression chamber S12 than the compression ratio of the first compression chamber S11, the flow resistance may be lowered, thereby effectively reducing an over-compression in the second compression chamber S12.

The first discharge outlet 326*a* and the second discharge outlet 326*b* may have a same shape as the first discharge inlet 325*a* and the second discharge inlet 325*b*. However, because the first discharge inlet 325*a* and the second discharge inlet 325*b* may have an irregular shape along a wrap curve, the first discharge outlet 326*a* and the second discharge outlet 326*b* may have a different shape from the first discharge inlet 325*a* and the second discharge inlet 325*b*.

The first discharge outlet 326*a* and the second discharge outlet 326*b* may be circular, taking into account an installation of a first valve 327*a* and a second valve 327*b*, which will be discussed hereinbelow.

The area of each of the first discharge outlet 326*a* and the second discharge outlet 326*b* may be greater than the area of each of the first discharge inlet 325*a* and the second discharge inlet 325*b*. However, this structure may cause an increase in a dead volume. Therefore, if possible, the first discharge outlet 326*a* and the second discharge outlet 326*b* may have a same area as or a slightly smaller area than the first discharge inlet 325*a* and the second discharge inlet 325*b* in consideration of the installation of the first valve 327*a* and the second valve 327*b*.

When the outlet 326*a*, 326*b* of the discharge port DP includes the first discharge outlet 326*a* and the second discharge outlet 326*b*, the first valve 327*a* and the second valve 327*b* may be independently installed at the respective outlets 326*a* and 326*b* of the discharge port DP. The first valve 327*a* and the second valve 327*b* may be check valves to prevent a discharged refrigerant from flowing back into the compression chambers S1, and may be implemented in various types, such as a piston valve, or a reed valve, for example.

The discharge port DP may also be provided with only one outlet 326*c*, which may be shared by the first discharge inlet 325*a* and the second discharge inlet 325*b* in a dividing manner. The outlet 326*c* of the discharge port DP may be formed to have an area which is the same as a total area of the first discharge inlet 325*a* and the second discharge inlet 325*b*. However, if employing this structure, the area of the outlet 326*c* of the discharge port DP may become too great, which may cause a difficulty in installation of a check valve, and also a refrigerant-discharge time point may be different, which may cause an increase in a dead volume in the compression chambers S11 and S12. On the other hand, if the outlet 326*c* of the discharge port DP has an extremely small area, the flow resistance may increase with respect to the refrigerant discharged from each of the first and second compression chambers S11 and S12, which may cause over-compression. Therefore, when the discharge port DP has the one outlet 326*c*, the outlet 326*c* may have a larger area, on a plane, than the area of the second discharge inlet 325*b*, which has a relatively larger area than the first discharge inlet 325*a*, and be formed to include about 30 to about 60% of each area of the first discharge inlet 325*a* and the second discharge inlet 325*b*. The outlet 326*c* of the discharge port DP may be formed close to the second discharge inlet 326*b*, which has the larger area than the first discharge inlet 325*a*, in view of reducing the over-compression in the second compression chamber S12, which has the relatively higher compression ratio.

Meanwhile, as the discharge port DP is formed toward the lower shell 13, a discharge cover 34 may be coupled to a lower surface of the fixed scroll 32 so as to store the discharged refrigerant and guide it toward a refrigerant passage $P_G$, which will be discussed hereinbelow. The discharge cover 34 may be coupled to the lower surface of the fixed scroll 32 in a sealing manner so as to separate a discharge passage (no reference numeral) of the refrigerant from an oil storage space 1*b*.

The discharge cover 34 may have an inner space, in which both the discharge port DP and an inlet of the refrigerant passage $P_G$ may be accommodated. The refrigerant passage $P_G$ may be formed through the fixed scroll 32 and the main frame 31 so as to guide a refrigerant, which may be discharged from the compression chamber S1 into the inner space of the discharge cover 34, toward the upper inner space 1*a* of the casing 1.

The discharge cover 34 may be provided with a through hole 341, through which an oil feeder 6 may be inserted. The oil feeder 6 may be coupled to a second bearing 52 of the rotational shaft 5, which will discussed hereinbelow, and sunk in the oil storage space 1*b* of the casing 1.

A sub bearing 328, to which the second bearing 52 of the rotational shaft 5, which will be discussed hereinbelow, may be penetratingly coupled, may be formed in an axial direction through a central portion of the disk 321 of the fixed scroll 32. A thrust bearing portion 329, which may support a lower end of the second bearing 52 in the axial direction, may protrude from an inner circumferential surface of the sub bearing 328.

The orbiting scroll 33 may include a disk 331 formed in an approximately circular shape, and the orbiting wrap 332 formed on a lower surface of the disk 331 and engaged with the fixed wrap 322 to form the compression chambers S1. A rotational shaft coupling portion 333, in which an eccentric portion 53 of the rotational shaft 5, which will be discussed hereinbelow, may be rotatably inserted, may be formed in the axial direction through a central portion of the disk 331. An outer circumference of the rotational shaft coupling portion 333 may be connected to the orbiting wrap 332 so as to form the compression chamber S1 along with the fixed wrap 322 during compression. The fixed wrap 322 and the orbiting wrap 332 may be formed in an involute shape, but also may be formed in other various shapes. That is, the orbiting wrap 332, similar to the fixed wrap 322, may have a shape including a plurality of arcs with different diameters and origin points connected such that a wrap curve may have irregularity. A recess 53*a* may be formed on an outer circumferential surface of the rotational shaft coupling portion 333 of the orbiting wrap 332. The increasing portion 53*b*, which may be engaged with the decreasing portion 322*b* of the fixed wrap 322, may be formed on one side surface of the rotational shaft coupling portion 333, thereby improving the compression ratio of the first compression chamber S11.

The eccentric portion 53 of the rotational shaft 5 may be inserted into the rotational shaft coupling portion 333, so as to overlap the orbiting wrap 332 or the fixed wrap 322 in a radial direction of the compressor. Accordingly, a repulsive force of a refrigerant may be applied to the fixed wrap 322 and the orbiting wrap 332 upon compression, and a compression force as a reaction force may be applied between the rotational shaft coupling portion 333 and the eccentric portion 53. In such a manner, when the eccentric portion 53 of the rotational shaft 5 penetrates through the disk 331 of the orbiting scroll 33 and overlaps the orbiting wrap 332 in the radial direction, the repulsive force and the compression force may be applied to a same plane based on the disk, thereby being attenuated by each other. This may result in preventing the orbiting scroll 33 from being inclined due to the applied compression force and repulsive force.

The rotational shaft 5 may have an upper portion press-fitted into a center of the rotor 22 and a lower portion coupled to the compression device 3, so as to be supported in the radial direction. Accordingly, the rotational shaft 5 may transfer a rotational farce of the motor 2 to the orbiting scroll 33 of the compression device 3. The orbiting scroll 33, which may be eccentrically coupled to the rotational shaft 5, may thus orbit with respect to the fixed scroll 32.

The first bearing 51, which may be inserted into the main bearing 311 of the main frame 31 to be supported in the radial direction, may be formed at a lower portion of the rotational shaft 5, and the second bearing 52, which may be inserted into the sub bearing 328 of the fixed scroll 32 to be supported in the radial direction, may be formed at a lower side of the main bearing 51. The eccentric portion 53, which may be coupled to the rotational shaft coupling portion 333 of the orbiting scroll 33 in an inserting manner, may be formed between the first bearing 51 and the second bearing 52. The first bearing 51 and the second bearing 52 may be coaxially formed to have a same axial center, and the eccentric portion 53 may be eccentric from the first bearing 51 or the second bearing 52 in the radial direction. The second bearing 52 may also be formed to be eccentric from the first bearing 51.

The eccentric portion 53 may have an outer diameter which is smaller than an outer diameter of the first bearing 51 and greater than an outer diameter of the second bearing 52, which may be advantageous in view of coupling the rotational shaft 5 through each bearing and the rotational shaft coupling portion 333. However, when the eccentric portion 53 is not integrally formed with the rotational shaft 5 but formed using a separate bearing, insertion of the rotational shaft 5 for coupling may be enabled even though the outer diameter of the second bearing 52 is not smaller than the outer diameter of the eccentric portion 53.

An oil passage 5*a*, through which oil may be supplied to each bearing and the eccentric portion 53, may be formed within the rotational shaft 5. As the compression device 3 is located lower than the motor 2, the oil passage 5*a* may be formed in a recessing manner from a lower end of the rotational shaft 5 up to an approximately lower end or an intermediate height of the stator 21, or up to a height higher than an upper end of the first bearing 51.

The oil feeder 6 to pump up oil filled in the oil storage space 1*b* may be coupled to the lower end of the rotational shaft 5, namely, a lower end of the second bearing 52. The oil feeder 6 may be provided with an oil supply pipe 61, which may be inserted into the oil passage 5*a* of the rotational shaft 5 for coupling, and an oil sucking member 62, such as a propeller, may be inserted into the oil supply pipe 61 to suck up the oil. The oil supply pipe 61 may be inserted through the through hole 341 of the discharge cover 34 so as to be sunk in the oil storage space 1*b*.

An oil-feeding hole and/or an oil-feeding slit may be formed at each of the bearings 51 and 52 and the eccentric portion 53 or between the bearings 51 and 52, such that the oil suck up through the oil passage 5*a* may be supplied to an outer circumferential surface of each of the bearings 51 and 52 and the eccentric portion 53.

Unexplained reference numerals 551, 553, and 556 denote oil-feeding holes.

The scroll compressor according to an embodiment may operate as follows.

That is, when power is applied to the motor 2 so as to generate a rotational force, the rotational shaft 5 coupled to the rotor 22 of the motor 2 may be rotated. In response, the orbiting scroll 33 coupled to the eccentric portion 53 of the rotational shaft 5 may continuously move while performing an orbiting motion, thereby forming between the orbiting wrap 332 and the fixed wrap 322 the plurality of compression chambers S1 which may include a suction chamber, an intermediate pressure chamber, and a discharge chamber. The compression chambers S1 may be continuously formed through several stages while their volumes are gradually decreased toward a central direction.

Accordingly, a refrigerant supplied from outside of the casing 1 through the refrigerant suction pipe 15 may be introduced directly into the compression chambers S1. The refrigerant may be compressed while moving toward the discharge chamber of the compression chambers S1 in response to the orbiting motion of the orbiting scroll 33, and then, may be discharged from the discharge chamber into the inner space 1*a* of the discharge cover 34 through the discharge port DP of the fixed scroll 32.

The compressed refrigerant discharged into the inner space 1*a* of the discharge cover 34 may then be discharged into the inner space 1*a* of the casing 1 through the refrigerant passage $P_G$, which may be formed along the fixed scroll 32 and the main frame 31, thereby being discharged out of the casing 1 through the refrigerant discharge pipe 16. This series of processes may be repeated.

As the discharge port DP has the plurality of inlets 325*a* and 325*b*, the refrigerants compressed in the first compression chamber S11 and the second compression chamber S12, respectively, may be discharged through the first discharge inlet 325*a* and the second discharge inlet 325*b* in a dividing manner. Accordingly, as compared with a structure having one discharge port DP, a bottle neck problem of the refrigerant discharged from each compression chamber S11 and S12 may be reduced, resulting in a reduction in over-compression loss, which may be caused due to delayed discharge.

Also, the over-compression loss, which may be caused in the second compression chamber S12, may be prevented in advance, by virtue of the structure that the first discharge inlet 325*a* and the second discharge inlet 325*b* have different areas from each other, with the area of the second discharge inlet 325*b* corresponding to the second compression chamber S12 having a relatively high compression ratio greater than the area of the first discharge inlet 325*a* corresponding to the first compression chamber S11 having a relatively low compression ratio.

When the first discharge inlet 325*a* and the second discharge inlet 325*b* independently communicate with the first and second discharge outlets 326*a* and 326*b* of the discharge port DP, the refrigerant compressed in each compression chamber S11 and S12 may be discharged more smoothly, thereby further reducing the over-compression loss in each compression chamber S11 and S12. In addition, when the area of the second discharge outlet 326*b* corresponding to the second compression chamber S12 having the relatively high compression ratio is greater than the area of the first discharge outlet 326*b*, the refrigerant of the second compression chamber S12 having the relatively high compression ratio may be discharged smoothly, whereby the over-compression loss of the second compression chamber S12 may be effectively reduced or prevented.

When the first discharge inlet 325*a* and the second discharge inlet 325*b* communicate with the one outlet 326*c* of the discharge port DP, a number of discharge valves may be reduced, in comparison with the case of employing the plurality of discharge outlets 326*a* and 326*b*, thereby reducing fabricating costs. However, in this case, if the outlet 326*c* of the discharge port DP is located at a middle portion between the first discharge inlet 325*a* and the second discharge inlet 325*b*, the over-compression loss in the second compression chamber S12 having the relatively high compression ratio may be increased. Therefore, when the discharge port DP is provided with the single outlet 326*c*, the outlet 326*c* of the discharge port DP may be formed closer to the second discharge inlet 325*b* or formed wide, so as to reduce the over-compression loss in the second compression chamber S12.

Hereinafter, description will be given of another embodiment of a discharge port DP for a scroll compressor disclosed herein.

That is, in the previous embodiment, the inlets 325*a* and 325*b* of the discharge port DP are separately formed from each other to correspond to the first compression chamber S11 and the second compression chamber 812, respectively. However, in this embodiment, one discharge inlet corresponding to the inlets 325*a* and 325*b* of the discharge port DP may be provided to correspond to both compression chambers S11 and S12.

Figure 7:
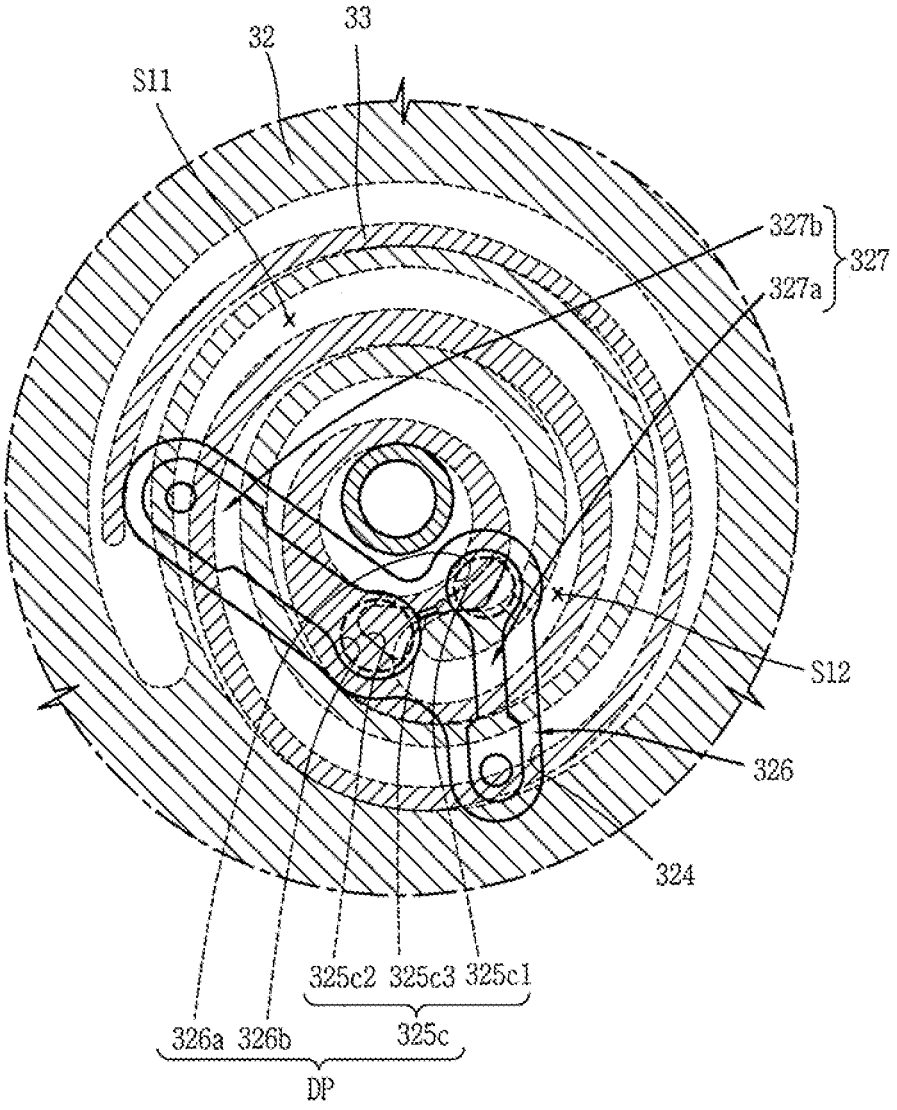

For example, as illustrated in FIG. 7, this embodiment illustrates that the discharge port DP may be provided with one discharge inlet 325*c*. Of course, in this case, the discharge inlet 325*c* cannot be formed at the center of the fixed scroll 32. Hence, the discharge inlet 325*c* may be formed relatively long for fast communicate with each compression chamber S11 and S12 at a discharge start time point of each of the first and second compression chambers S11 and S12. However, when the discharge inlet 325*c* is formed long enough to accommodate both the first and second compression chambers S11 and S12 therein, a dead volume may be increased and a refrigerant leakage may be caused from the second compression chamber S12, which has a relatively high compression ratio and high discharge speed, into the first compression chamber S11, which has a relatively low compression ratio and discharge speed. Therefore, the one discharge inlet 325*c* may be provided with a first discharge inlet portion 325*c*1 and a second discharge inlet portion 325*c*2, so as to have a similar shape to the previous embodiment even though the only one discharge inlet 325*c* is employed. Also, a discharge communication portion 325*c*3 may be formed with a narrow interval between the first discharge inlet portion 325*c*1 and the second discharge inlet portion 325*c*2. The discharge communication portion 325*c*3 may be formed through the first and second discharge inlet portions 325*c*1 and 325*c*2, or formed in a shape of a recess, such that the first and second discharge inlet portions 325*c*1 and 325*c*2 may partially communicate with each other therealong.

The first discharge inlet portion 325*c*1 and the second discharge inlet portion 325*c*2 may be formed, such that an area of the second discharge inlet portion 325*c*2 may be greater than an area of the first discharge inlet portion 325*c*1, similar to the first discharge inlet 325*a* and the second discharge inlet 325*b* of the previous embodiment.

Figure 6:
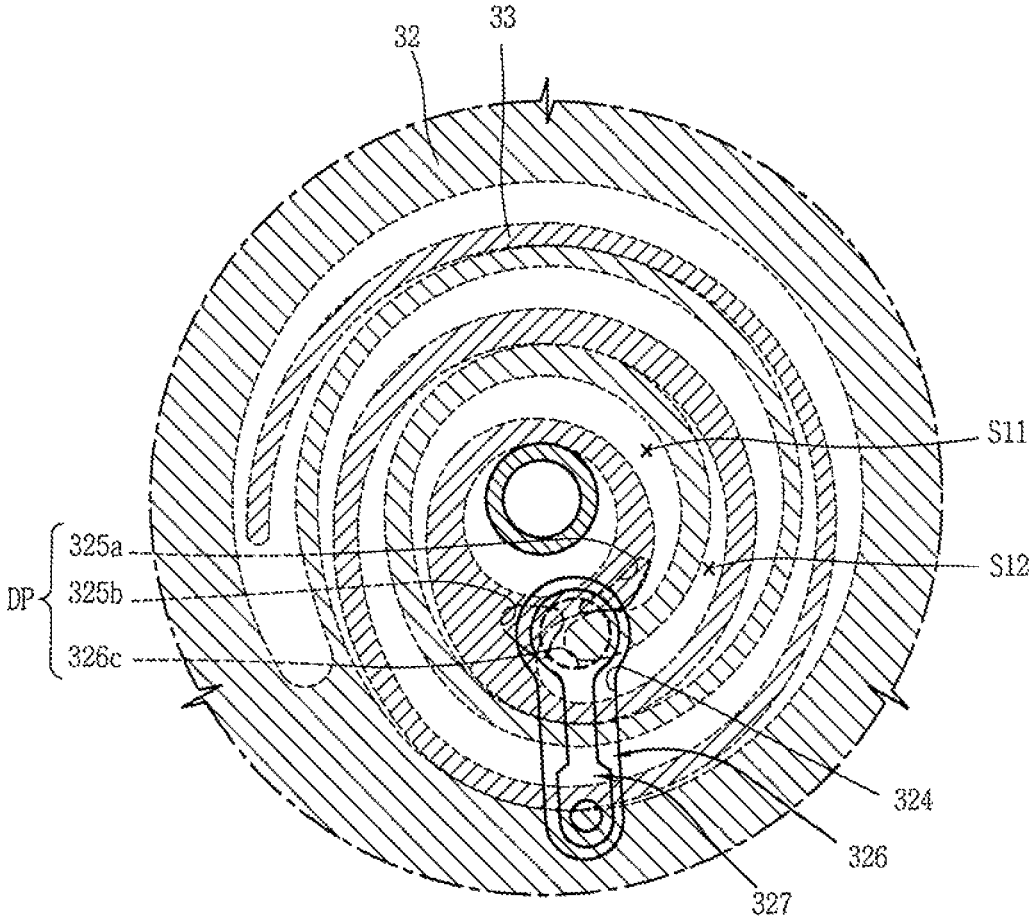
FIGS. 6 and 7 are planar views illustrating another embodiment of the discharge port of FIG. 2.

The first discharge inlet portion 325*c*1 and the second discharge inlet portion 325*c*2 may communicate with the first discharge outlet 326*a* and the second discharge outlet 326*b*, as illustrated in FIG. 7, or communicate with the one discharge outlet 326*c*, as illustrated in FIG. 6. When the first discharge outlet 326*a* and the second discharge outlet 326*b* are provided, an area of the second discharge outlet 326*b* may be greater than an area of the first discharge outlet 326*b*. When the one discharge outlet 326*c* is provided, the discharge outlet 326*c* may be formed close to the second discharge inlet portion 325*c*2 or formed wide toward the second discharge inlet portion 325*c*2. Thusly-obtained operation effects may be the same or similar to the previous embodiment, so description thereof has been omitted.

The inlets 235*a*, 235*b* and the outlets 326*a*, 326*b* of the discharge port DP may have different shapes from each other. The inlets 325*a*, 325*b* of the discharge port DP may be formed on the fixed scroll 32, and valve plate 326, which may include the outlets 326*a*, 326*b* of the discharge port DP that communicate with the inlets 325*a*, 325*b* of the discharge port DP, may be coupled to a lower surface of the fixed scroll 32.

Plate mounting recess 324 may be recessed into the lower surface of the fixed scroll 32 by a predetermined depth. In view of reducing a dead volume of the discharge port DP, the valve plate 326 may be inserted into the plate mounting recess 324.

Referring to FIG. 5, the second discharge inlet 325*b* may be formed to be open earlier than the first discharge inlet 325*a*. This may allow the refrigerant of the second compression chamber S12 having the relatively high compression ratio to be discharged earlier than the refrigerant of the first compression chamber S11 having the relatively low compression ratio. This may result in more effective prevention of over-compression loss in the second compression chamber S12. Of course, the second discharge inlet 325*b* may be formed to be opened at the same time point as the first discharge inlet 325*a*.

An open state of the second discharge inlet 325*b* may partially overlap an open state of the first discharge inlet

325*a*. This may allow the refrigerant, which may be discharged through the second discharge inlet 325*b*, to be also discharged through the first discharge inlet 325*a*, which may be maintained in an open state for a predetermined period of time even after the discharge start time point thereof, thereby preventing over-compression loss due to lack of discharge in the second compression chamber S12.

Hereinafter, description will be given of another embodiment of a scroll compressor disclosed herein.

That is, the previous embodiment has illustrated the discharge port DP in the bottom compression type scroll compressor in which the compression device 3 is located below the motor 2. However, this embodiment illustrates that the discharge port may also be applied to a top compression type scroll compressor in which the compression device 3 is located above the motor 2.

Figure 8:
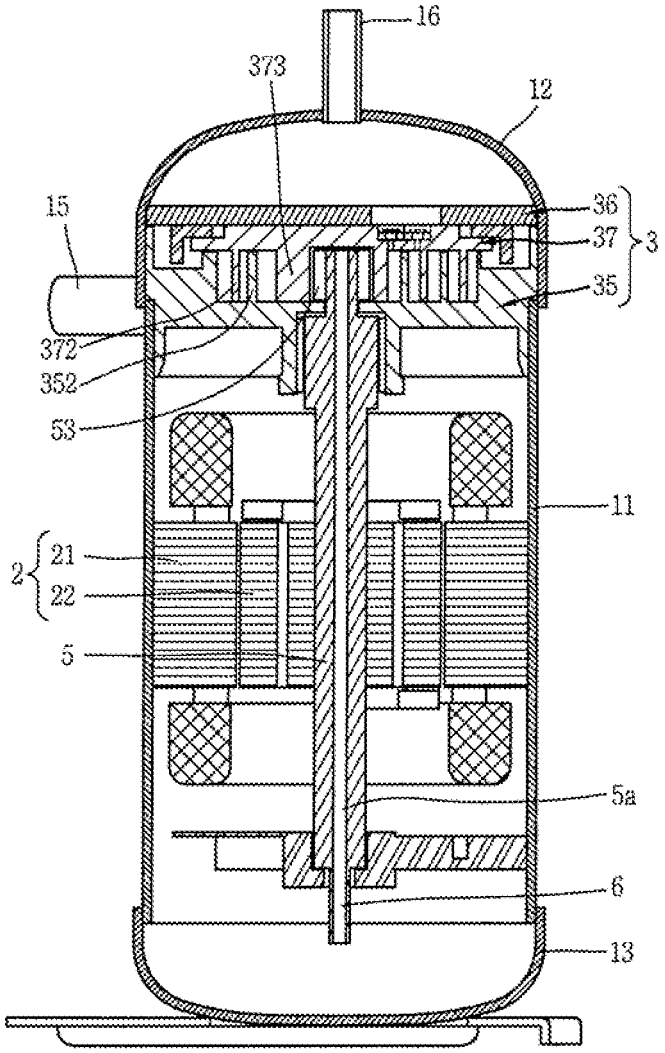
FIG. 8 is a sectional view of a scroll compressor in accordance with another embodiment.
Figure 9:
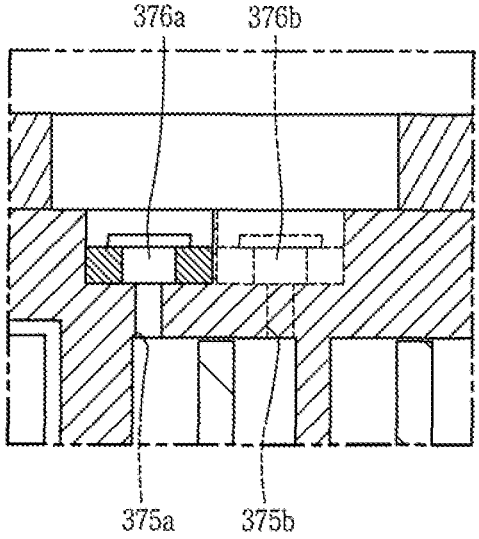
FIG. 9 is an enlarged longitudinal sectional view illustrating a surrounding area of a discharge port of the scroll compressor of FIG. 8.

A top compression type scroll compressor disclosed herein, as illustrated in FIGS. 8 and 9, may include motor 2 installed at a lower side within casing 1, and compression device 3 located above the motor 2.

The compression device 3 may include a frame 35 having fixed wrap 352 and fixed to the casing 1, a plate 36 coupled to an upper surface of the frame 35, and an orbiting scroll 37 having an orbiting wrap 372 provided between the frame 35 and the plate 36 and engaged with the fixed wrap 352 to form a plurality of compression chambers S1.

The orbiting scroll 37 may be provided with a rotational shaft coupling portion 373, to which an eccentric portion 53 of a rotational shaft 5 coupled to a rotor 22 of the motor 2 may be eccentrically coupled. The rotational shaft coupling portion 373 may be formed such that the eccentric portion 53 overlaps the compression chambers S1 in a radial direction.

The orbiting scroll 37 may be provided with a discharge port through which a compressed refrigerant may be discharged into the inner space of the casing 1. As illustrated in the previous embodiments, the discharge port may be provided with a plurality of discharge inlets 375*a* and 375*b* and discharge outlets 376*a* and 376*b*, or provided with a plurality of discharge inlets and one discharge outlet. Also, the discharge port may be provided with one discharge inlet and a plurality of discharge outlets, or one discharge inlet and one discharge outlet.

Shapes of the discharge inlet and the discharge outlet or thusly-obtained operation effects may be the same or similar to the previous embodiments, so detailed description thereof has been omitted.

Embodiments disclosed herein provide a scroll compressor, capable of preventing an over-compression loss due to a delay of discharge by way of forming independent discharge passages for smooth discharge of refrigerants from respective first and second compression chambers. Embodiments disclosed herein further provide a scroll compressor, capable of more effectively preventing an over-compression loss due to a delay of discharge by way of allowing a refrigerant of a compression chamber with a relatively high compression ratio to be more smoothly discharged.

Embodiments disclosed herein provide a scroll compressor that may include a first scroll that is provided with a discharge port, a second scroll that is engaged with the first scroll to form a first compression chamber and a second compression chamber, and a rotational shaft that is provided with an eccentric portion eccentrically coupled to the first scroll or the second scroll. The eccentric portion may overlap the compression chambers in a radial direction. The discharge port may be provided with a discharge inlet and a discharge outlet, and the discharge inlet may be provided in plurality, which may be located at an outside of the eccentric portion in the radial direction.

The first compression chamber and the second compression chamber may have different compression ratios from each other. An area of a discharge inlet that communicates with a compression chamber having a relatively high compression ratio, of the plurality of discharge inlets, may be greater than an area of another discharge inlet that communicates with another compression chamber having a relatively low compression ratio.

The discharge outlet may be provided in plurality, which may communicate with the discharge inlets in an independent manner. The plurality of discharge outlets may have different areas from each other, and an area of a discharge that outlet communicates with a compression chamber having a high compression ratio, of the first and second compression chambers, may be greater than an area of another discharge outlet.

A plurality of discharge outlets that communicates with the plurality of discharge inlets may be provided on one side surface of the first scroll. The plurality of discharge outlets may be opened and closed by a plurality of valves, respectively.

One discharge outlet that communicates with the plurality of discharge inlets may be provided on one side surface of the first scroll. The one discharge outlet may be opened and closed by one valve.

The first compression chamber and the second compression chamber may have different compression ratios from each other, and an opening time point of a discharge inlet that communicates with a compression chamber having a relatively high compression ratio, of the plurality of discharge inlets, may be earlier than or the same as an opening time point of another discharge inlet that communicates with another compression chamber having a relatively low compression ratio. Open states of the plurality of discharge inlets may at least partially overlap each other.

Embodiments disclosed herein further provide a scroll compressor that may include a first scroll that is provided with a discharge port, a second scroll that is engaged with the first scroll to form a first compression chamber and a second compression chamber, and a rotational shaft that is provided with an eccentric portion eccentrically coupled to the first scroll or the second scroll. The eccentric portion may overlap the compression chambers in a radial direction. The discharge port may be provided with one discharge inlet and a plurality of discharge outlets, and the discharge inlet may be located at an outside of the eccentric portion in the radial direction.

The first compression chamber and the second compression chamber may have different compression ratios from each other. An area of one side of the discharge inlet, adjacent to a compression chamber having a relatively high compression ratio, may be greater than an area of the other side thereof, adjacent to another compression chamber.

The discharge inlet may include a first discharge inlet portion that is located adjacent to the first compression chamber, a second discharge inlet portion that is adjacent to the second compression chamber, and a discharging communication portion by which the first discharge inlet portion and the second discharge inlet portion communicate with each other. A plurality of discharge outlets that communicates with the one discharge inlet may be provided on one side surface of the first scroll. The plurality of discharge outlets may be independently opened and closed by respectively valves.

Embodiments disclosed herein further provide a scroll compressor that may include a first scroll that is provided with a discharge port, a second scroll that is engaged with the first scroll to form a first compression chamber and a second compression chamber, and a rotational shaft that is provided with an eccentric portion eccentrically coupled to the first scroll or the second scroll. The eccentric portion may overlap the compression chambers in a radial direction. The discharge port may be provided with a discharge inlet and a discharge outlet. The discharge inlet may be provided in plurality, which may be located at an outside of the eccentric portion in the radial direction, and provided with a first discharge inlet that communicates with the first compression chamber and a second discharge inlet that communicates with the second compression chamber. An opening time point of a discharge inlet that communicates with a compression chamber having a relatively high compression ratio, of the plurality of discharge inlets, may be earlier than or the same as an opening time point of another discharge inlet that communicates with another compression chamber having a relatively low compression ratio. Open states of the plurality of discharge inlets may at least partially overlap each other.

A scroll compressor according to embodiments disclosed herein may employ a discharge port for a first compression chamber and a discharge port for a second compression chamber in a separate manner, such that a refrigerant of each compression chamber may be smoothly discharged, thereby preventing an over-compression loss due to a delay of discharge.

Also, a discharge port of a compression chamber having a high compression ratio may be configured to be opened earlier than a discharge port of a compression chamber having a low compression ratio, and a discharge port corresponding to a compression chamber having a relatively high compression ratio may be formed to have a wide area such that a refrigerant of the compression chamber having the relatively high compression ratio maybe more smoothly discharged, thereby preventing the over-compression loss more effectively.

Further scope of applicability of embodiments will become more apparent from the detailed description. However, it should be understood that the detailed description and specific examples, while indicating embodiments, are given by way of illustration only, since various changes and modifications within the spirit and scope will become apparent to those skilled in the art from the detailed description.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment" "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a first scroll provided with a discharge port;

a second scroll engaged with the first scroll to form a first compression chamber and a second compression chamber; and a rotational shaft provided with an eccentric portion eccentrically coupled to the first scroll or the second scroll, wherein the eccentric portion overlaps the first and second compression chambers in a radial direction, wherein the discharge port comprises a plurality of discharge inlets located at an outside of the eccentric portion in the radial direction and at least one discharge outlet, wherein the first compression chamber and the second compression chamber have different compression ratios from each other, wherein an area of a first discharge inlet of the plurality of discharge inlets, that communicates with the first compression chamber having a relatively high compression ratio is different than an area of a second discharge inlet of the plurality of discharge inlets, that communicates with the second compression chamber having a relatively low compression ration.

2. The scroll compressor of claim 1, wherein the area of the first discharge inlet of the plurality of discharge inlets, that communicates with the first compression chamber having a relatively high compression ratio is greater than the area of the second discharge inlet of the plurality of discharge inlets, that communicates with the second compression chamber having a relatively low compression ratio.

3. The scroll compressor of claim 1, wherein the at least one discharge outlet comprises a plurality of discharge outlets that communicates with the plurality of discharge inlets in an independent manner.

4. The scroll compressor of claim 3, wherein the plurality of discharge outlets has different areas from each other, and wherein an area of a first discharge outlet of the plurality of discharge outlets, that communicates with the first compression chamber having a relatively high compression ratio is greater than an area of a second discharge outlet of the plurality of discharge outlets.

5. The scroll compressor of claim 3, wherein the plurality of discharge outlets that communicates with the plurality of discharge inlets is provided at one side surface of the first scroll, and wherein the plurality of discharge outlets are opened and closed by a plurality of valves, respectively.

6. The scroll compressor of claim 1, wherein the at least one discharge outlet comprises one discharge outlet provided on or at one side surface of the first scroll, and wherein the one discharge outlet is opened and closed by one valve.

7. The scroll compressor of claim 6, wherein the one discharge outlet overlaps the plurality of discharge inlets in a circumferential direction.

8. The scroll compressor of claim 1, wherein an opening time point of the first discharge inlet of the plurality of discharge inlets, that communicates with the first compression chamber having a relatively high compression ratio is earlier than or the same as an opening time point of the second discharge inlet of the plurality of discharge inlets, that communicates with the second compression chamber having a relatively low compression ratio.

9. The scroll compressor of claim 8, wherein open states of the plurality of discharge inlets at least partially overlap each other.

10. A scroll compressor, comprising:

a first scroll provided with a discharge port;

a second scroll engaged with the first scroll to form a first compression chamber and a second compression chamber; and a rotational shaft provided with an eccentric portion eccentrically coupled to the first scroll or the second scroll, wherein the eccentric portion overlaps the first and second compression chambers in a radial direction, and wherein the discharge port comprises one discharge inlet and a plurality of discharge outlets, and wherein the one discharge inlet is located at an outside of the eccentric portion in the radial direction.

11. The scroll compressor of claim 10, wherein the first compression chamber and the second compression chamber have different compression ratios from each other, and wherein an area of a first side of the discharge inlet, adjacent to the first compression chamber having a relatively high compression ratio, is greater than an area of a second side of the discharge inlet, adjacent to the second compression chamber.

12. The scroll compressor of claim 10, wherein the one discharge inlet comprises:

a first discharge inlet portion located adjacent to the first compression chamber;

a second discharge inlet portion located adjacent to the second compression chamber; and a discharging communication portion by which the first discharge inlet portion and the second discharge inlet portion communicate with each other.

13. The scroll compressor of claim 10, wherein the plurality of discharge outlets that communicates with the one discharge inlet is provided on one side surface of the first scroll, and wherein the plurality of discharge outlets is independently opened and closed, respectively, by a plurality of valves.

14. The scroll compressor according to claim 10, wherein the one discharge inlet extends a length sufficient to communicate with both the first compression chamber and the second compression chamber.

15. The scroll compressor according to claim 10, wherein the one discharge inlet overlaps the plurality of discharge outlets in the circumferential direction.

16. A scroll compressor, comprising:

a first scroll provided with a discharge port;

a second scroll engaged with the first scroll to form a first compression chamber and a second compression chamber; and a rotational shaft provided with an eccentric portion eccentrically coupled to the first scroll or the second scroll, wherein the eccentric portion overlaps the compression chambers in a radial direction, wherein the discharge port comprises a plurality of discharge inlets and at least one discharge outlet, wherein the plurality of discharge inlets is located at an outside of the eccentric portion in the radial direction and includes a first discharge inlet that communicates with the first compression chamber and a second discharge inlet that communicates with the second compression chamber, wherein an opening time point of the first discharge inlet that communicates with the first compression chamber having a relatively high compression ratio is earlier than or the same as an opening time point of the second discharge inlet that communicates with the second compression chamber having a relatively low compression ratio.

17. The scroll compressor of claim 16, wherein open states of the plurality of discharge inlets at least partially overlap each other.

18. The scroll compressor of claim 16, wherein the plurality of inlets overlaps the at least one discharge outlet in a circumferential direction.

* * * * *